United States Patent [19]

Santilli

[11] Patent Number: 4,743,718

[45] Date of Patent: May 10, 1988

[54] ELECTRICAL CONTACTS FOR VACUUM INTERRUPTER DEVICES

[75] Inventor: Vincent J. Santilli, Corning, N.Y.

[73] Assignee: Westinghouse Electric Corp., Pittsburgh, Pa.

[21] Appl. No.: 72,317

[22] Filed: Jul. 13, 1987

[51] Int. Cl.[4] ..... H01H 33/66

[52] U.S. Cl. ..... 200/144 B; 200/265; 200/266

[58] Field of Search ..... 200/144 B

[56] References Cited

U.S. PATENT DOCUMENTS

| | | | |
|---|---|---|---|
| 2,362,007 | 11/1944 | Hemsel et al. | 75/200 |
| 2,758,229 | 8/1956 | Perry | 200/266 |
| 3,246,979 | 4/1966 | Lafferty et al. | 200/266 |
| 3,818,163 | 6/1974 | Robinson | 200/144 B |
| 3,960,554 | 6/1976 | Gainer | 75/200 |
| 4,190,753 | 2/1980 | Gainer | 200/144 B |
| 4,204,863 | 5/1980 | Schreiner | 200/265 |
| 4,299,889 | 11/1981 | Kato et al. | 75/248 |
| 4,424,429 | 1/1984 | Yamanaka et al. | 200/266 |
| 4,501,941 | 2/1985 | Cherry | 200/144 B |

*Primary Examiner*—Robert S. Macon
*Attorney, Agent, or Firm*—Daniel P. Cillo

[57] ABSTRACT

A vacuum interrupter device 11 with contacts 21 and 27 formed from a mixture of copper, chromium, bismuth, and at least about 0.5 weight percent of chromic oxide. The mixture can additionally include small amounts of silver, iron and titanium. The chromic oxide hinders copper grain growth, binds bismuth in the matrix, and increases vacuum dielectric strength in the vacuum interrupter.

14 Claims, 1 Drawing Sheet

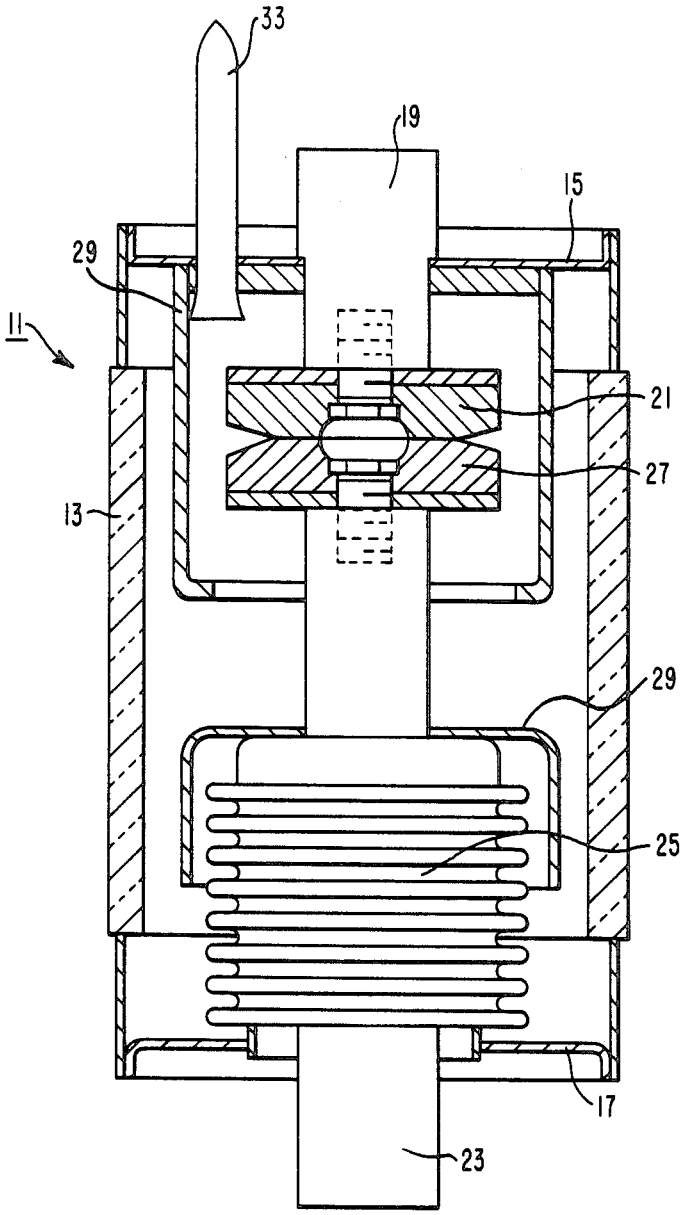
33
19
15
29
11
21
27
13
29
25
17
23

ELECTRICAL CONTACTS FOR VACUUM INTERRUPTER DEVICES

TECHNICAL FIELD

The present invention relates to vacuum interrupter electrical apparatus and more particularly to the electrical contacts of such apparatus.

BACKGROUND OF THE INVENTION

Vacuum interrupters find application as circuit protection devices in electrical distribution and motor control systems, and comprise a sealed envelope with movable contacts disposed within the envelope for making and breaking electrical continuity. When the contacts are in a closed current carrying position in contact with each other, the contact must carry large currents efficiently with low resistance values. When the contacts are first separated to open the circuit, an arc is struck between the contacts, vaporizing some portion of the contacts, followed by a rapid quenching of the arc when the contacts are fully open, and interruption of the circuit. The contacts must be readily separable, i.e., have an antiweld characteristic so that the operating mechanism need not exert undue force in moving the contacts apart. While some vaporization of the contact material is necessary to sustain the arc, gross erosion of the contacts is to be avoided since this will give rise to high contact resistance when the contacts are closed for current carrying operation.

The selection of contact materials is therefore a very critical aspect in the functioning of the whole vacuum interrupter apparatus. A widely used contact material is a blend of a high-conductivity material such as copper, with a higher melting point refractory material such as chromium or tungsten. There are a variety of metallurgical processes known by which such contacts can be manufactured. U.S. Pat. Nos. 3,960,554 and 4,190,753 teach chromium-copper vacuum interrupter contacts. U.S. Pat. No. 3,818,163 teaches the use of a chromium or cobalt matrix contact material which is infiltrated with copper and silver. U.S. Pat. No. 2,362,007 teaches the use of about 10% chromium, some phosphorus and the remainder copper, while U.S. Pat. No. 2,758,229 describes an electrical current commutator which is approximately 70% to 90% copper and a 10% to 30% total of chromium, lead, nickel, tin, cadmium, and iron. U.S. Pat. No. 4,299,889 discloses a copper-tungsten mixture. A copper-bismuth mixture is discussed in U.S. Pat. No. 3,246,979, while U.S. Pat. No. 4,204,863 teaches contact material made from mixtures of two silver oxides, for example AgCdO plus AgZnO, while U.S. Pat. No. 4,501,941 teaches contacts made from copper, chromium, and aluminum oxide.

Yamanaka et al., in U.S. Pat. No. 4,424,429 teaches conventional contacts which contain 60 wt.% copper, 25 wt.% chromium, and 15% bismuth. These contacts are said to have rough grains of bismuth. The inventors solve this problem by providing contactors containing 60 wt.% copper or silver; 25 wt.% chromium, tungsten, molybdenum, cobalt or iron; 15 wt.% of an oxide additive having a melting point lower than copper (m.p. 1083° C.) or silver (m.p. 961° C.), selected from bismuth oxide (m.p. 820° C.), thallium oxide (m.p. 300° C.), indium oxide (In m.p. 155° C.), antimony oxide (m.p. 655° C.) or tellurium oxide (m.p. 733° C.); and optionally a titanium compound. These components are mixed as dry powders, compressed, and sintered in a non-oxidative atmosphere, in a vacuum or high purity hydrogen furnace at 1000° C. for 2 hours. While this method provides a fine uniform bismuth layer in continuous network form, an even more improved vacuum interrupter contact is desirable.

It is an object of this interrupter to provide a vacuum interrupter contact material which exhibits high current interruption, low weld strengths, low chop currents at a given voltage, low erosion characteristics, and strong bonding of the bismuth component.

SUMMARY OF THE INVENTION

A vacuum interrupter contact, formed from the pressed briquette powder mixture of this invention exhibits high current interruption, low weld strength and low chop current. The powder mixture, prior to sintering, is pressed into a porous briquette form, and comprises 50 wt.% to 75 wt.% copper, 15 wt.% to 30 wt.% chromium, 2.5 wt.% to 15 wt.% bismuth and 0.5 wt.% to 7.5 wt.% chromic oxide. The mixture can additionally include small amounts of silver, iron, titanium, and the like, approximately 0.5 wt.% to 2 wt.% each. The interrupter contact is formed by reaction sintering this powdered, pressed mixture, at a temperature and in a gas having a low dew point which is effective to form some additional oxides of chromium and retain $Cr_2O_3$ in its oxidized form. This increases the total concentration of chromium oxides, while retaining the remaining chromium and the other major components in reduced form. This gas is partly oxidative to chromium and reductive to copper and bismuth. The term "partly oxidative to chromium" means that only part of the bulk chromium will be oxidized at sintering temperatures.

The resulting sintered contact preferably contains fine grain copper, highly dispersed bismuth, about 10 wt.% to 25 wt.% chromium, and about 4 wt.% to 15 wt.% of oxides of chromium, mostly chromic oxide ($Cr_2O_3$), with some $CrO_3$. The formation of chromic oxide in an interparticle, bonding, surrounding cellular structure, permeating the copper-bismuth-chromium matrix inhibits growth of large grains of copper, aids densification of the powder mixture by fusing particle to particle via the oxide bond, and, very importantly, locks finely dispersed bismuth in the matrix. The interrupter of the invention, utilizing contacts containing chromic oxide, and large, controllable amounts of bismuth, exhibits a low chop current, a 10% to 35% increase in vacuum dielectric strength at from a 2 mm to 4 mm gap, and has a very low failure rate at high voltage and high current.

BRIEF DESCRIPTION OF THE DRAWING

The invention will become more apparent by reading the following detailed description in connection with the accompanying drawing, which is shown by way of example only, wherein the drawing is an elevational view, partly in section of a vacuum interrupter assembly.

DESCRIPTION OF THE PREFERRED EMBODIMENT

Turning to the Drawing, a vacuum interrupter device, generally indicated by the reference character 11, is illustrative of the type of devices in which the vacuum interrupter contacts according to this invention can be utilized. The vacuum interrupter device 11 comprises a generally cylindrical insulating body portion 13, having sealed end plate members 15 and 17 at opposed ends of the body 13. A fixed contact assembly 19 is brought through end plate 15 and has a first of two contacts 21 consisting of the presently disclosed compound disposed at the terminal end of the conductive post of the contact assembly. The other contact assembly 23 is movably mounted through the end plate 17 and includes a bellows member 25 which permits movement of the second of two contacts 27 disposed at the end of the assembly. Thus the two contacts 21 and 27 are movable into either closed circuit contact with each other or an open circuit, spaced relation relative to each other. A plurality of vapor shields, as at 29, are provided within the sealed envelope about the contacts, the arcing area, and the bellows 25. The various shields prevent the direct deposition of arcing material upon the insulating envelope and bellows.

The body portion 13 of the vacuum interrupter device 11 is provided with an evacuation port means 33 by which, through the use of a pump means or the like attached thereto, the interior atmosphere of the device 11 is evacuated to render a vacuum device. The port means 33, which as illustrated herein is a tube like member, is then pinched off or otherwise vacuum sealed in order to maintain the vacuum condition of the device.

The vacuum interrupter contacts 21 and 27 can be simple disc-like members, but more typicaly they will have a more complex shape, which may include spirally directed arms for producing a circular arc driving force to keep the formed arc in motion about the contact and minimize localized heating. A typical contact of the present invention is fabricated as a formed disc which may have some structural detail. For added strength, the contact can be supported by a metal disc.

The contacts can be formed by homogeneously mixing the component materials, placing the mixture in an appropriate press die, and cold molding at about 54,545 kg (60 tons) preferably in an isostatic press, to form a 50% to 65% porous, low density, "green" briquette compact or pill. The briquette is then sintered at from about 750° C. to about 1000° C. in a flowing stream of gas, such as cracked ammmonia, hydrogen gas, or the like, having a low dew point, preferably hydrogen gas.

As is well known from metal-metal oxide equilibria tables plotting temperature vs. dew point, chromium and titanium, in certain gases, such as hydrogen or cracked ammonia, having a low Dew Point, will be oxidized at certain temperatures, while other metals, such as copper and bismuth will be reduced. The gas used in this method of sintering has a low dew point of about −34° C. to about −50° C., and contains at least about 0.006 vol.% of water vapor, usually from 0.006 vol.% to about 0.03 vol.% of water vapor. This minor amount of water vapor present provides a partial oxidizing effect for some of the bulk Cr, and prevents reduction of $Cr_2O_3$ or $CrO_3$ formed or present. However, the remainder of the chromium, and the other major components, such as copper and bismuth, will be in reduced form after the sintering step is completed. Of the minor components that may be present, silver and iron will be reduced, but titanium will be at least partly oxidized. Water content of over about 0.03 vol.% in the gas may provide too much $Cr_2O_3$, i.e., a total of over about 7.5 wt.%, providing too much insulative effect.

Although it is not completely understood at this time, the chromic oxide powder ($Cr_2O_3$) additive is essential to provide "seed" material for bulk Cr oxidation and particle to particle attachment. After sintering, where pressure may or may not be used, the formed contact will have a density of from 90% to 95%. The contact can then be pressed again at a higher pressure, and sintered a second time in a similar gas, with a low dew point, to provide higher densities of up to about 98%. Further reference can be made to U.S. Pat. No. 4,190,753, herein incorporated by reference, for further details on interrupter contact cold molding techniques and densification.

The vacuum interrupter contacts made according to the present invention contain a mixture of materials which have been shown by high power electrical tests to possess highly desirable characteristics, such as high current interruption, low weld strengths and low erosions at given voltages. The preferred composition by which these characteristics are obtained renders a multi-component contact comprising copper (Cu), chromium (Cr), bismuth (Bi) and chromic oxide ($Cr_2O_3$), with a possible nominal presence of silver (Ag), iron (Fe), titanium (Ti) and the like. By "nominal presence" is meant a presence in the composition of these elements in a small amount above an impurity level, that is, approximately 0.5% to 2% or more by weight of the mixture. It has been found best to add a small amount of "seed" $Cr_2O_3$ and partially oxidize bulk Cr, to get the appropriate final $Cr_2O_3+CrO_3$ content, rather than adding all the oxide as $Cr_2O_3$.

One embodiment of the powder mixture and briquette of this invention is provided in Table I which sets forth the components, the acceptable percentage range by weight of the components and the percentage of the component present in the most preferred embodiment of the invention.

TABLE I

| Pre-Sinter Briquette | wt % Range | wt. % Preferred |
|---|---|---|
| copper (Cu) | 50–75 | 55–65 |
| chromium (Cr) | 15–30 | 24–30 |
| chromic oxide ($Cr_2O_3$) | 0.5–7.5 | 1–3 |
| bismuth (Bi) | 2.5–15 | 5–15 |
| silver (Ag) | 0–2% | 0–2% |
| iron (Fe) | 0–1% | 0–1% |
| titanium (Ti) | 0–1% | 0–1% |

It has been determined through experimentation that a contact having a final content of bismuth which is approximately 12% to 15% by weight provides outstanding vacuum interrupter contact characteristics, coupled with low contact erosion when interrupting currents in the range of approximately 7 kA to 9 kA. An amount of at least about 0.5 wt.% $Cr_2O_3$, having at melting point higher than copper and bismuth, (chromic oxide or chromium oxide, m.p. 2435° C.) assures further oxidation of Cr during sintering in hydrogen gas containing at least 0.006 vol.% $H_2O$, formation of up to about 5 wt.% of oxides of chromium, such as $Cr_2O_3$ and $CrO_3$ in the bulk of the final, sintered contact, and dispersion of bismuth throughout the fine matrix of solid solute. The ranges of 50 wt.% to 75 wt.% Cu and 2.5 wt.% to 15 wt.% Bi remain essentially the same through sintering, with less of Cr and addition of oxides of chromium selected from $Cr_2O_3$, $CrO_3$ and their mixures. The bismuth will be finely and homogeneously dispersed and locked with small grain copper particles in the copper-chromium-bismuth matrix. The oxides of chromium will be effective to bind the matrix in an interdispersed, uniformly distributed, cellular network.

Use of over about 7.5 wt.% $Cr_2O_3$ in the pre-sinter mixture creates practical problems of hardness for machining, matrix uniformity, pitting of the contact, and provides too much insulative effect.

While the preferred embodiment can include some small amount of silver, iron, or titanium, a satisfactory contact can be prepared with the use of only copper, chromium, bismuth, and chromic oxide. However, in a sintered Cu—Cr—Bi—$Cr_2O_3$/$CrO_3$ contact, it is important that bismuth be present in the pre-sintered mixture in the range of between about 2.5% to 10%, preferably greater than 5% by weight. Preferably, the particle sizes of the Cu and Cr pre-sintered powders will range from about 37μ to 150μ and the particles sizes of the Bi and $Cr_2O_3$ pre-sintered powders will range from about 1μ to 25μ.

The dielectric strength of a Cu—Cr—Bi—$Cr_2O_3$/$CrO_3$ contact having a nominal 3 cm (1.2 inch) diameter has been found sufficient to prevent flashover of about 50 kV in a gap of 4 mm. Lower gaps have decreased dielectric strength, i.e., a gap of 2 mm has a lower flashover of approximately 25 kV. However, a 4 mm gap is the nominal gap used to interrupt currents in the range of 7 kA to 9 kA.

What has been described is a contact material for vacuum interrupter devices in which the current interruption is high at medium voltages of about 5 kV to 7 kV. In addition, the weld strength is low and the erosion due to high currents is low. This is accomplished through the use of four main constituents, copper, chromium, bismuth, and chromic oxide, and in the preferred embodiment, silver, iron and titanium may be added in nominal amounts to the mixture. The inclusion of bismuth in the contact mixture lends its low chop characteristic to the contact. The inclusion of chromic oxide strengthens the sintered contact, hampers copper grain growth, keeping substantially all copper grains below about 300 microns diameter, and preferably 85% below about 250 microns diameter, helps bind the uniformly distributed bismuth to repress bismuth vaporization during arcing, and provides improvement in vacuum dielectric strength.

EXAMPLE

A vacuum interrupter having 3 cm (1.2 inch) diameter contacts similar to 21 to 27 shown in the Drawing, was made. The pre-sinter powder mixture for the contacts contained 60 wt.% Cu powder of 38μ to 150μ particle size, 24 wt.% Cr powder of 38μ to 150μ particle size, 13 wt.% Bi powder of 1μ to 25μ particle size, 1 wt.% $Cr_2O_3$ powder of 1μ to 25μ particle size, and 2 wt.% Ag powder of 1μ to 25μ particle size. As a Control Sample, the same contacts were made without $Cr_2O_3$ or Ag powder.

Both samples were homogeneously mixed for about ½ hour, placed in an appropriate contact die, and cold isostatic pressed to form a "green" 60% porous briquette structure, that had the same composition as the powder mixture. Both briquette samples were then sintered in a furnace for 2 hours at 850° C. in a continuous flow of pure hydrogen gas, having a dew point of −30° C. i.e., containing about 0.03 vol.% of $H_2O$ vapor, to form contact samples. This gas was partly oxidative to chromium and reductive to copper and bismuth, so that only some of the Cr would be converted to $Cr_2O_3$. Both contact samples after sintering and cooling were about 92% dense. They were then tested and the results as well as the initial and final compositions are given below in Table II.

TABLE II

| | INITIAL COMPOSITION | SINTERED COMPOSITION | COPPER GRAIN SIZE* | VACUUM DIELECTRIC STRENGTH GAP 2 mm | VACUUM DIELECTRIC STRENGTH GAP 4 mm | FAILURE AT 4 mn GAP AND 4kA CURRENT** |
|---|---|---|---|---|---|---|
| INVENTION SAMPLE | 60 wt. % Cu | 60 wt. % Cu | 14% = 127μ+ | 26 kV | 54 kV | 13% of 81 tests |
| | 24 wt. % Cr | 20 wt. % Cr | 24% = 76μ | | | |
| | 13 wt. % Bi | 13 wt. % Bi | 41% = 63μ | | | |
| | 1 wt. % $Cr_2O_3$ | 5 wt. % $Cr_2O_3$ + $CrO_3$ | 20% = 44μ | | | |
| | 2 wt. % Ag | 2 wt. % Ag | | | | |
| CONTROL SAMPLE | 60 wt. % Cu | 60 wt. % Cu | 56% = 127μ+ | 18 kV | 38 kV | 37% of 43 tests |
| | 27 wt. % Cr | 27 wt. % Cr | 13% = 100μ | | | |
| | 13 wt. % Bi | 13 wt. % Bi | 31% = 50μ | | | |

*200× magnification
**"Failure" means current passage across gap via discharge.

The improvement in lowering copper grain size and increasing vacuum dielectric strength is solely the result of $Cr_2O_3$ inclusion and formation of $Cr_2O_3$ from bulk Cr. Silver inclusion would not help in either of these areas.

After arc extinguishment and post microscopic analysis, the Invention Sample showed only minor Bi whisker growth on the surface of the contact, due to Bi vaporization, whereas such whiskers were much more evident on the control sample, indicating that the Bi was much more dispersed and held within the matrix of the invention sample. Photomicrographs showed $Cr_2O_3$ interdispersed in a binding, interparticle cellular structure, surrounding and impregnating in a uniformly distributed, continuous web fashion the other components of the contact. As can be seen from Table II, the invention sample is dramatically superior to the Control Sample.

What is claimed is:

1. A porous briquette, useful as a vacuum interrupter contact after sintering, containing a powder mixture comprising 50 to 75 weight percent copper, 15 to 30 weight percent chromium, 2.5 to 15 weight percent bismuth and 0.5 to 7.5 weight percent chromic oxide.

2. The briquette according to claim 1, where the chromic oxide constitutes from 1 to 3 percent by weight of the mixture.

3. The briquette according to claim 1, where the mixture also includes at least one metal selected from the group consisting of silver, iron, and titanium in an amount greater than an impurity level.

4. A dense vacuum interrupter contact obtained by sintering, in an atmosphere partly oxidative to chromium and reductive to copper and bismuth, a powder mixture comprising 50 to 75 weight percent copper, 15 to 30 weight percent chromium, 2.5 to 15 weight percent bismuth, and 0.5 to 7.5 weight percent chromic oxide, said interrupter characterized by high current interruption and a high dispersion of bismuth.

5. The vacuum interrupter contact according to claim 4, wherein the chromic oxide constitutes from 1 to 3 percent by weight of the mixture.

6. The vacuum interrupter contact according to claim 4, wherein the mixture also includes at least one metal selected from the group consisting of silver, iron and titanium in an amount greater than an impurity level.

7. A dense vacuum interrupter contact which exhibits high current interruption, obtained by sintering a mixture comprising copper, chromium and bismuth, the improvement characterized in that the mixture is sintered in an atmosphere partly oxidative to chromium and reductive to copper and bismuth, and also contains from 0.5 to 7.5 weight percent of $Cr_2O_3$.

8. The vacuum interrupter contact according to claim 7, wherein the $Cr_2O_3$ constitutes from 1 to 3 percent by weight of the mixture.

9. A dense, sintered vacuum interrupter contact comprising 2.5 to 15 weight percent bismuth finely dispersed among 50 to 75 weight percent copper grains having a particle size below 300 microns, with the remainder of the contact containing chromium, and oxides of chromium selected from the group consisting of $Cr_2O_3$, $CrO_3$, and their mixtures, where the oxides of chromium surround the copper, bismuth and chromium, in a binding, uniformly distributed network.

10. A vacuum interrupter device 11, comprising a pair of dense, sintered contacts 21 and 27 movable into either a closed circuit contact with each other or an open circuit, spaced relation relative to each other, said contacts obtained by sintering in an atmosphere partly oxidative to chromium and reductive to copper and bismuth, a mixture comprising 50 to 75 weight percent coopper, 15 to 30 weight percent chromium, 2.5 to 15 weight percent bismuth, and 0.5 to 7.5 weight percent chromic oxide.

11. The vacuum interrupter device according to claim 10, wherein the mixture includes from 1 to 3 percent by weight of chromic oxide.

12. A method of making a vacuum interrupter contact comprising the steps of:

(A) providing a mixture comprising:
  (a) 50 to 75 weight percent copper,
  (b) 15 to 30 weight percent chromium,
  (c) 2.5 to 15 weight percent bismuth, and
  (d) 0.5 to 7.5 weight percent chromic oxide, (B) cold pressing the mixture to form a contact briquette, (C) sintering the briquette in a flow of a gas that contains water vapor, so that chromium is oxidized, to produce a dense contact, and (D) cooling the sintered contact.

13. The method of claim 12, where the mixture includes from 1 to 3 percent by weight of chromic oxide.

14. The method of claim 12, where the gas is hydrogen gas, water vapor is present in the hydrogen gas at over 0.006 volume percent, and sintering is carried out at from about 750° C. to about 1000° C.

* * * * *